US011854322B1

(12) United States Patent
Kumar et al.

(10) Patent No.: US 11,854,322 B1
(45) Date of Patent: Dec. 26, 2023

(54) SMART SUSTAINABLE PACKAGING SYSTEM AND PROCESS

(71) Applicant: Dell Products L.P., Round Rock, TX (US)

(72) Inventors: Dhilip S. Kumar, Bangalore (IN); Shibi Panikkar, Bangalore (IN); Rohit Gosain, Bangalore (IN)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/875,509

(22) Filed: Jul. 28, 2022

(51) Int. Cl.
*G07C 9/00* (2020.01)

(52) U.S. Cl.
CPC ..... *G07C 9/00309* (2013.01)

(58) Field of Classification Search
None
See application file for complete search history.

(56) References Cited

U.S. PATENT DOCUMENTS

2017/0103647 A1* 4/2017 Davis ..... H04W 12/068
2018/0082577 A1* 3/2018 Davis ..... H04W 12/082
2018/0096593 A1* 4/2018 Davis ..... G06F 1/3287
2019/0043298 A1* 2/2019 Moudy ..... B65D 81/18
2019/0180402 A1* 6/2019 Nakajima ..... G07F 17/13
2019/0392660 A1* 12/2019 Eichenblatt ..... G06Q 20/18
2021/0059455 A1* 3/2021 Bowman ..... B65D 81/18
2021/0209548 A1* 7/2021 Katz ..... B60R 25/2018
2021/0287168 A1* 9/2021 Arora ..... G06Q 10/0832
2022/0058575 A1* 2/2022 Moudy ..... H04L 67/125
2022/0189223 A1* 6/2022 Carter ..... H04W 4/021
2022/0198003 A1* 6/2022 Shaver ..... G06F 8/70
2022/0257041 A1* 8/2022 Redford ..... B65D 11/186
2023/0042956 A1* 2/2023 Carter ..... B64C 39/024
2023/0084587 A1* 3/2023 Fisher ..... B62D 51/007 180/9.22
2023/0157472 A1* 5/2023 Barkman ..... A47G 29/20 232/1 R

OTHER PUBLICATIONS

P. Forbes et al., "Implementing Genuinely Sustainable Packaging In A Small Brand," https://packhelp.com/sustainable-packaging/, Accessed Jul. 18, 2022, 28 pages.
G. Lawton, "Near-Field Communication (NFC)" https://www.techtarget.com/searchmobilecomputing/definition/Near-Field-Communication#:~:text=George, Accessed Jul. 18, 2022, 5 pages.
F. Nicasio, "Why You Need to Offer Sustainable Packaging—and How to Do It Right," https://www.bigcommerce.com/blog/author/francesca-nicasio-noissue/, Accessed Jul. 18, 2022, 29 pages.

* cited by examiner

*Primary Examiner* — Carlos Garcia
(74) *Attorney, Agent, or Firm* — Ryan, Mason & Lewis, LLP

(57) ABSTRACT

A method comprises transmitting order data to at least one package configured for electronically receiving the order data and accommodating one or more items therein, wherein the at least one package is electronically locked. In the method, an access code for electronically unlocking the at least one package is generated and transmitted to a user device. The method also includes receiving a notification that the at least one package was unlocked, wherein the notification is received in response to electronically unlocking the at least one package with the access code.

20 Claims, 17 Drawing Sheets

SMART SUSTAINABLE PACKAGING SYSTEM AND PROCESS

FIELD

The field relates generally to information processing systems, and more particularly to a sustainable packaging system.

BACKGROUND

Packaging plays a significant role in business as it protects the goods stored therein during transportation. Although packaging primarily protects goods from damage, many organizations use packaging for other functions such as, for example, identifying the organization and products inside the packaging, marketing and communicating package contents and their details to customers and other stakeholders.

Some organizations are adopting sustainable packaging, which refers to the development and use of packaging solutions that have a minimal environmental impact and eco-system footprint. For example, some original equipment manufacturers (OEMs) use diesel carbon as ink for labels and bio-degradable packaging for laptops. However, when an organization utilizes sustainable packaging, the organization may forgo some of the functions that packaging provides.

SUMMARY

Illustrative embodiments provide techniques for implementing sustainable packaging.

In one embodiment, a method comprises transmitting order data to at least one package configured for electronically receiving the order data and accommodating one or more items therein, wherein the at least one package is electronically locked. In the method, an access code for electronically unlocking the at least one package is generated and transmitted to a user device. The method also includes receiving a notification that the at least one package was unlocked, wherein the notification is received in response to electronically unlocking the at least one package with the access code.

Further illustrative embodiments are provided in the form of a non-transitory computer-readable storage medium having embodied therein executable program code that when executed by a processor causes the processor to perform the above steps. Still further illustrative embodiments comprise an apparatus with a processor and a memory configured to perform the above steps.

These and other features and advantages of embodiments described herein will become more apparent from the accompanying drawings and the following detailed description.

DETAILED DESCRIPTION

Figure 1:
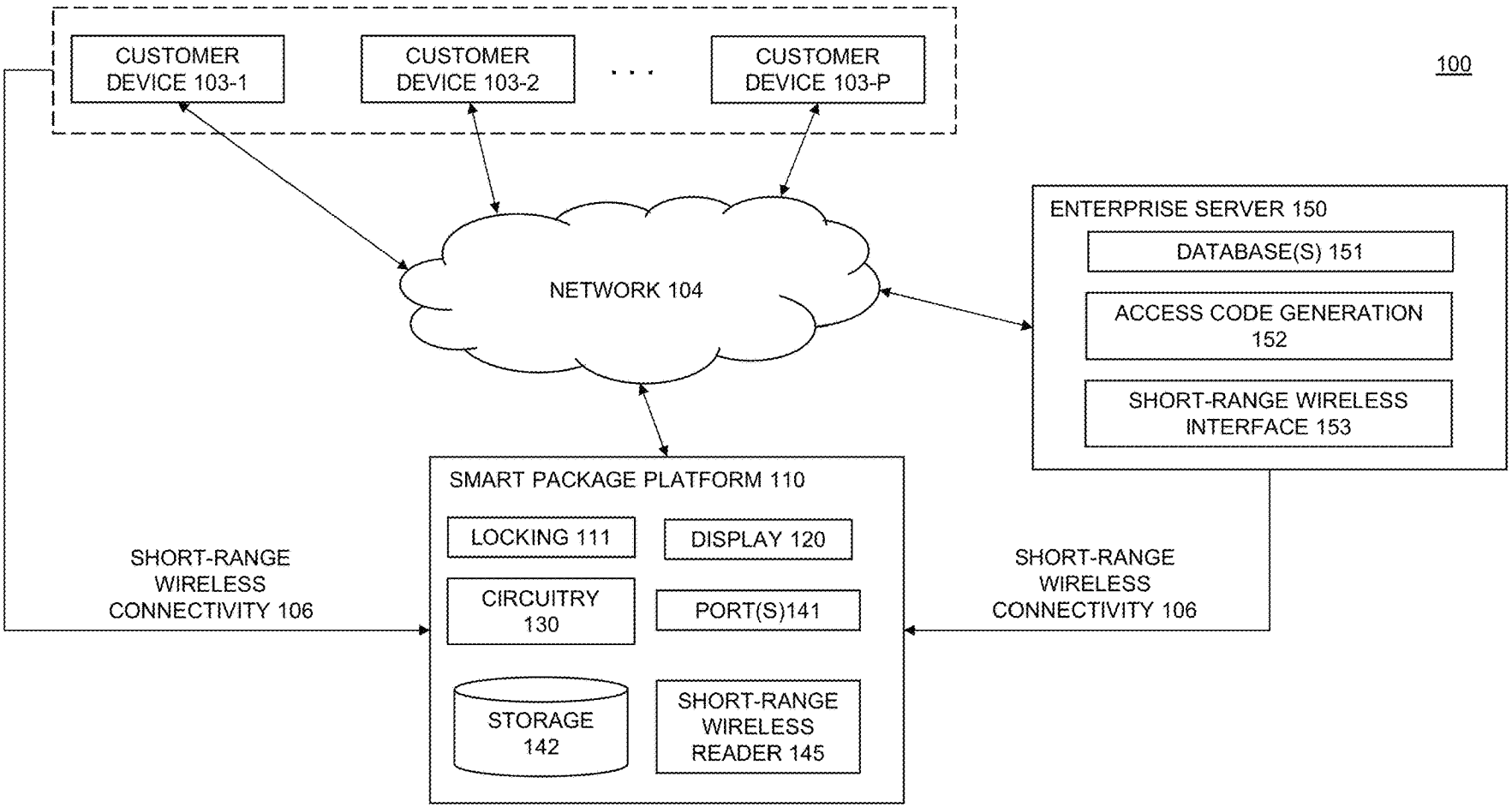
FIG. 1 depicts details of an information processing system with a smart package platform according to an illustrative embodiment.

Illustrative embodiments will be described herein with reference to exemplary information processing systems and associated computers, servers, storage devices and other processing devices. It is to be appreciated, however, that embodiments are not restricted to use with the particular illustrative system and device configurations shown. Accordingly, the term "information processing system" as used herein is intended to be broadly construed, so as to encompass, for example, processing systems comprising cloud computing and storage systems, as well as other types of processing systems comprising various combinations of physical and virtual processing resources. An information processing system may therefore comprise, for example, at least one data center or other type of cloud-based system that includes one or more clouds hosting tenants that access cloud resources. Such systems are considered examples of what are more generally referred to herein as cloud-based computing environments. Some cloud infrastructures are within the exclusive control and management of a given enterprise, and therefore are considered "private clouds." The term "enterprise" as used herein is intended to be broadly construed, and may comprise, for example, one or more businesses, one or more corporations or any other one or more entities, groups, or organizations. An "entity" as illustratively used herein may be a person or system. On the other hand, cloud infrastructures that are used by multiple enterprises, and not necessarily controlled or managed by any of the multiple enterprises but rather respectively controlled and managed by third-party cloud providers, are typically considered "public clouds." Enterprises can choose to host their applications or services on private clouds, public clouds, and/or a combination of private and public clouds (hybrid clouds) with a vast array of computing resources attached to or otherwise a part of the infrastructure. Numerous other types of enterprise computing and storage systems are also encompassed by the term "information processing system" as that term is broadly used herein.

As used herein, "real-time" refers to output within strict time constraints. Real-time output can be understood to be instantaneous or on the order of milliseconds or microseconds. Real-time output can occur when the connections with a network are continuous and a user device receives messages without any significant time delay. Of course, it should be understood that depending on the particular temporal nature of the system in which an embodiment is implemented, other appropriate timescales that provide at least contemporaneous performance and output can be achieved.

As used herein, "sustainable packaging" or "sustainable package" refers to earth-friendly packaging or packages that have minimal environmental impact and footprint. For example, a sustainable package may include recycled or raw materials, may be reusable and may be manufactured using minimized production processes that have low supply chain and carbon footprints.

Illustrative embodiments provide a sustainable packaging system with features such as, but not limited to, proof of delivery, label and ink-use avoidance, and re-usability. The illustrative embodiments advantageously source, develop, and implement packaging solutions with minimal environmental impact and footprint.

FIG. 1 shows an information processing system 100 configured in accordance with an illustrative embodiment. The information processing system 100 comprises customer devices 103-1, 103-2, . . . 103-P (collectively "customer devices 103"), a smart package platform 110 and an enterprise server 150. The customer devices 103, smart package platform 110 and enterprise server 150 are connected to a network 104.

The customer devices 103 and enterprise server 150 can comprise, for example, Internet of Things (IoT) devices, desktop, laptop or tablet computers, mobile telephones, or other types of processing devices capable of communicating over the network 104. Such devices are examples of what are more generally referred to herein as "processing devices." Some of these processing devices are also generally referred to herein as "computers." The customer devices 103 and enterprise server 150 may also or alternately comprise virtualized computing resources, such as virtual machines (VMs), containers, etc. The customer devices 103 and enterprise server 150 in some embodiments comprise respective computers associated with a particular company, organization or other enterprise. The variable P, and other similar index variables herein such as K and L are assumed to be arbitrary positive integers greater than or equal to 1.

The terms "customer" or "user" herein are intended to be broadly construed so as to encompass numerous arrangements of human, hardware, software or firmware entities, as well as combinations of such entities. At least a portion of the available services and functionalities provided by the enterprise server 150 in some embodiments may be provided under Function-as-a-Service ("FaaS"), Containers-as-a-Service ("CaaS") and/or Platform-as-a-Service ("PaaS") models, including cloud-based FaaS, CaaS and PaaS environments.

Although not explicitly shown in FIG. 1, one or more input-output devices such as keyboards, displays or other types of input-output devices may be used to support one or more user interfaces to the smart package platform 110 and/or enterprise server 150, as well as to support communication between the smart package platform 110 and/or enterprise server 150 and connected devices (e.g., customer devices 103), and/or between other related systems and devices not explicitly shown.

The network 104 is assumed to comprise a portion of a global computer network such as the Internet, although other types of networks can be part of or comprise the network 104, including a wide area network (WAN), a local area network (LAN), a satellite network, a telephone or cable network, a cellular network, a wireless network such as a WiFi or WiMAX network, or various portions or combinations of these and other types of networks. The network 104 in some embodiments therefore comprises combinations of multiple different types of networks. A given network may comprise processing devices configured to communicate using Internet Protocol (IP) or other related communication protocols.

As a more particular example, some embodiments may utilize one or more high-speed local networks in which associated processing devices communicate with one another utilizing Peripheral Component Interconnect express (PCIe) cards of those devices, and networking protocols such as InfiniBand, Gigabit Ethernet or Fibre Channel. Numerous alternative networking arrangements are possible in a given embodiment, as will be appreciated by those skilled in the art.

As explained further herein, in some embodiments, connections between the enterprise server 150 and the smart package platform 110 and/or between customer devices 103 and the smart package platform 110 may be performed using short-range wireless connectivity 106 such as, for example, near-field communication (NFC), Bluetooth®, radio-frequency identification (RFID) and/or other short-range wireless connectivity techniques. NFC, for example, uses magnetic field induction to enable communication between devices when the devices are touched together or brought within a few centimeters of each other. The short-range wireless connectivity techniques may be used in connection with other short-range wireless connectivity techniques (e.g., NFC with RFID, RFID tag and/or other contactless capabilities) and/or with one or more networks (e.g., network 104). As explained in more detail herein, the short-range wireless connectivity techniques may be used transfer relatively small amounts of data and perform different functions (e.g., activating or deactivating a locking mechanism).

Referring to FIG. 1, the smart package platform 110 comprises a locking component 111, a display 120, circuitry 130, one or more ports 141, a storage component 142, and a short-range wireless reader 145. The enterprise server 150 comprises one or more databases 151, an access code generation component 152 and a short-range wireless interface 153.

Figure 2A:
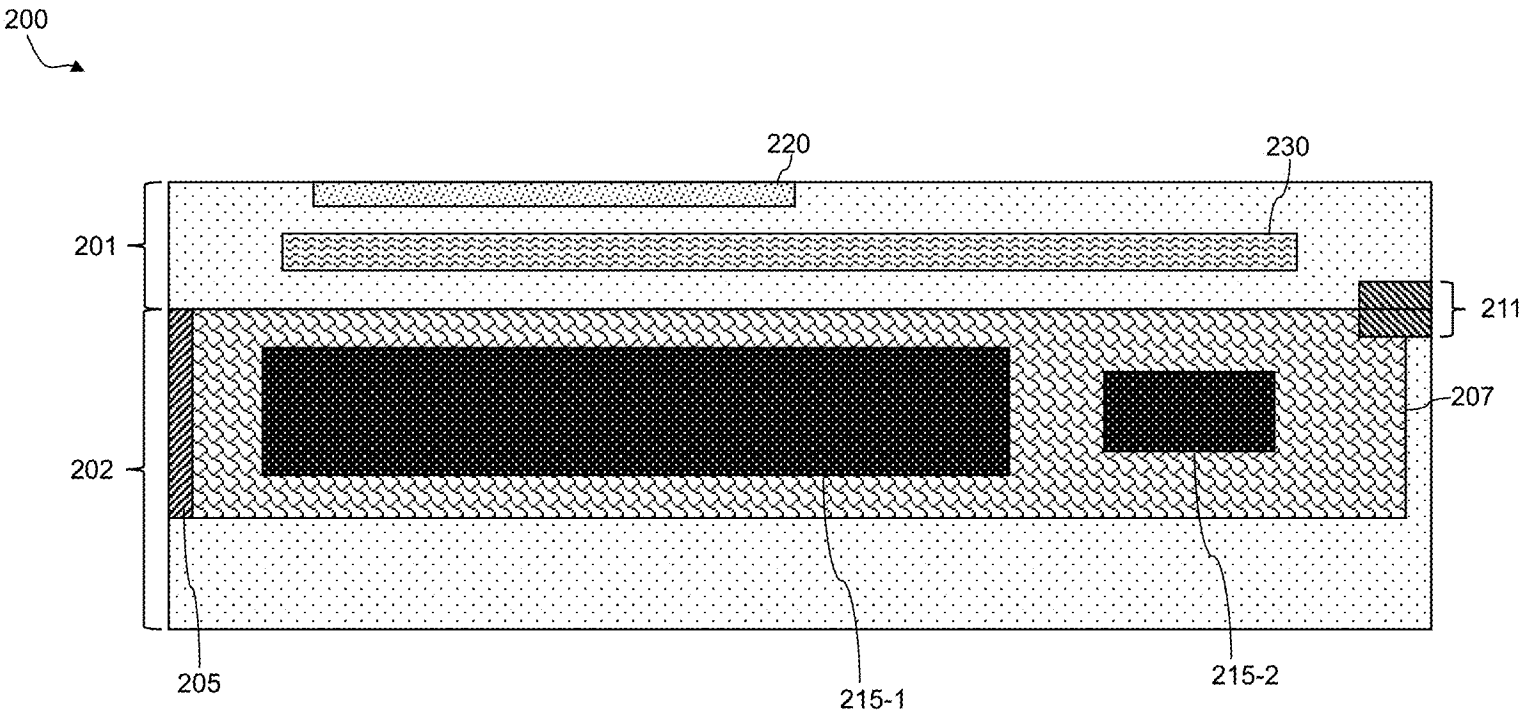
FIG. 2A depicts a side cross-sectional view of a sustainable package according to an illustrative embodiment.
Figure 2B:
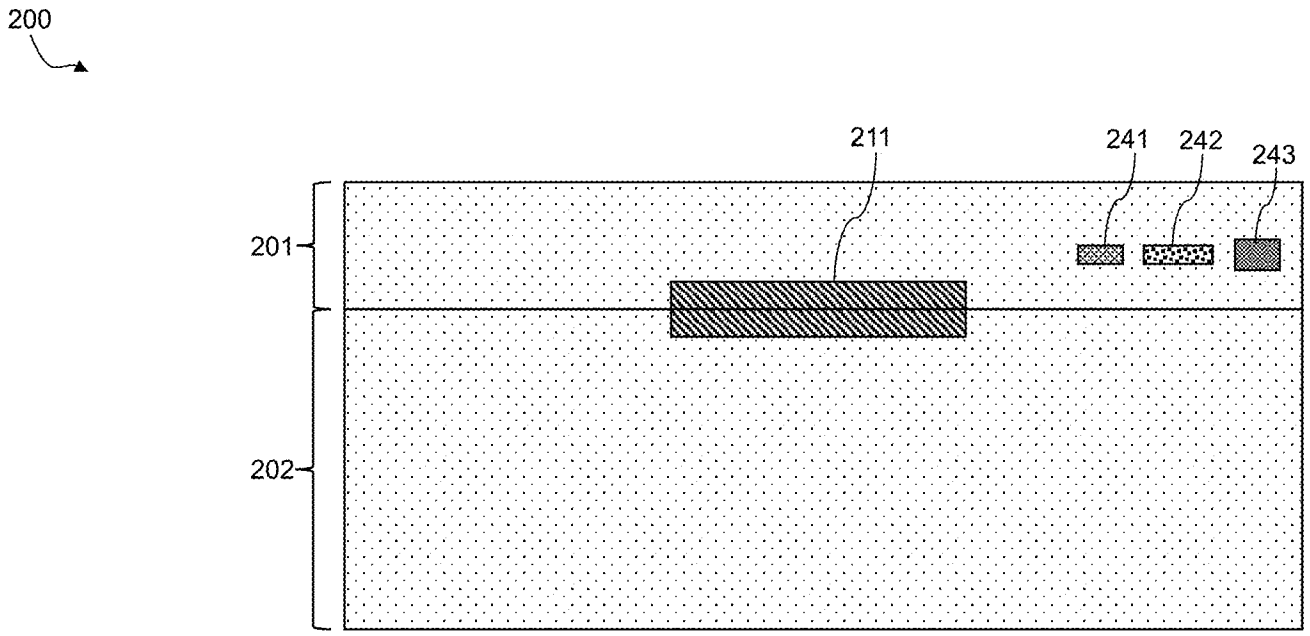
FIG. 2B depicts a front view of a sustainable package according to an illustrative embodiment.
Figure 2C:
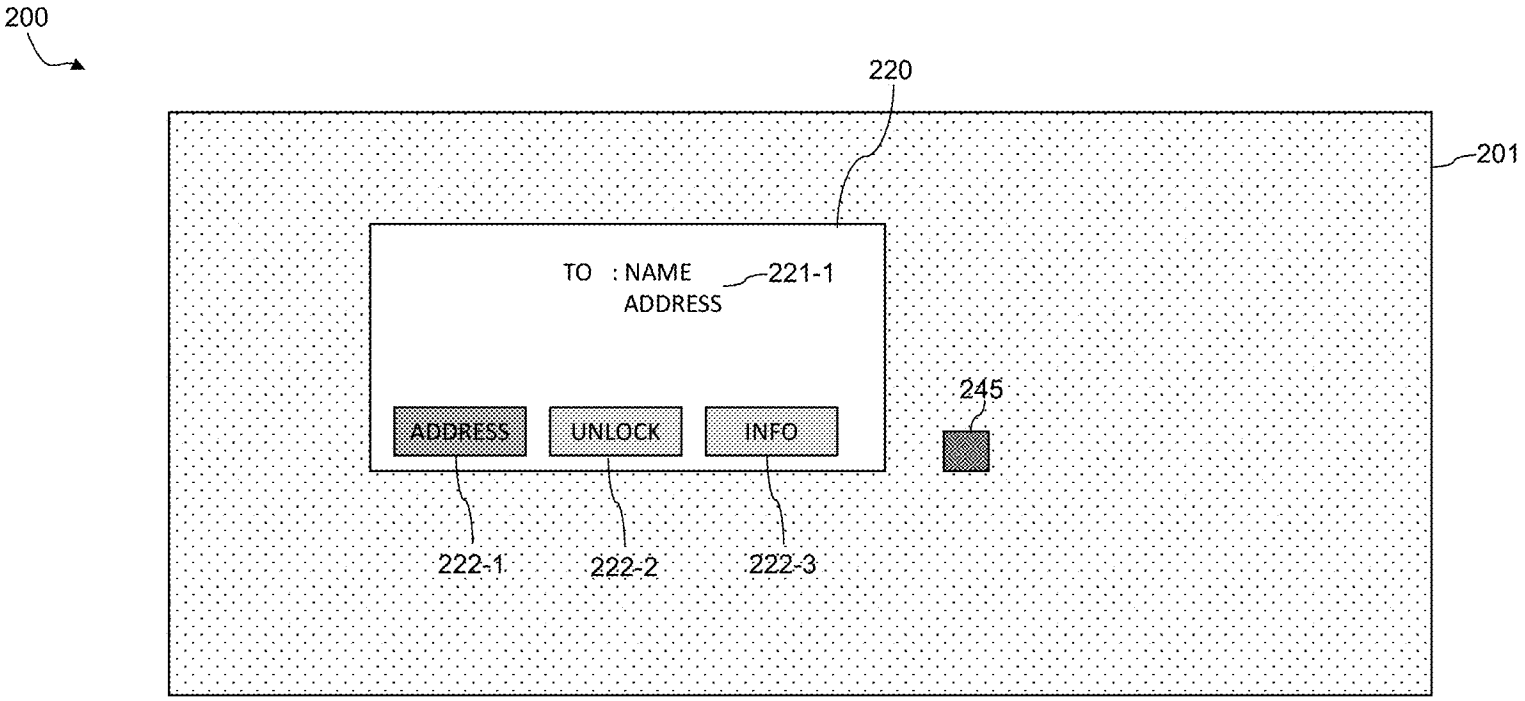
FIG. 2C depicts a top view of a sustainable package including a display panel displaying destination information according to an illustrative embodiment.
Figure 2D:
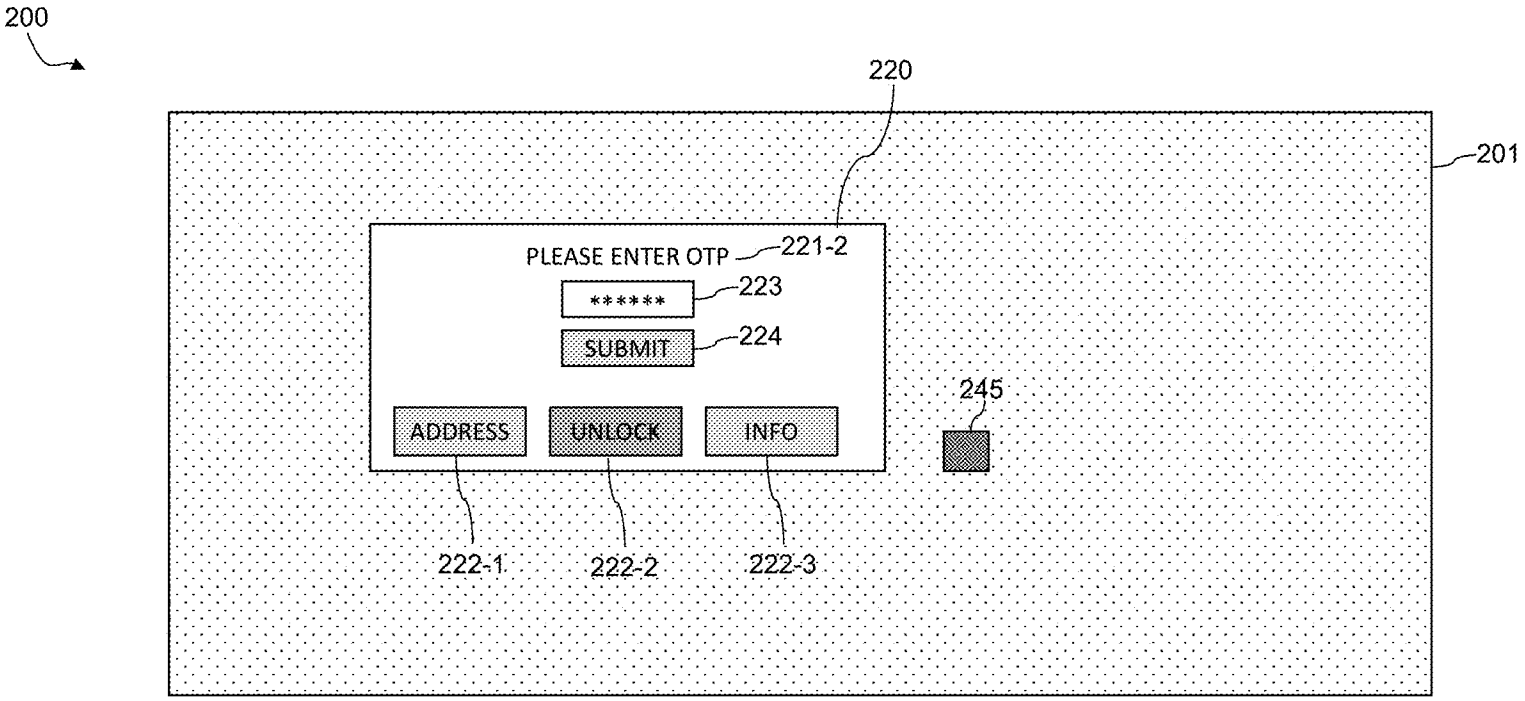
FIG. 2D depicts a top view of a sustainable package including a display panel displaying unlocking functionality according to an illustrative embodiment.
Figure 2E:
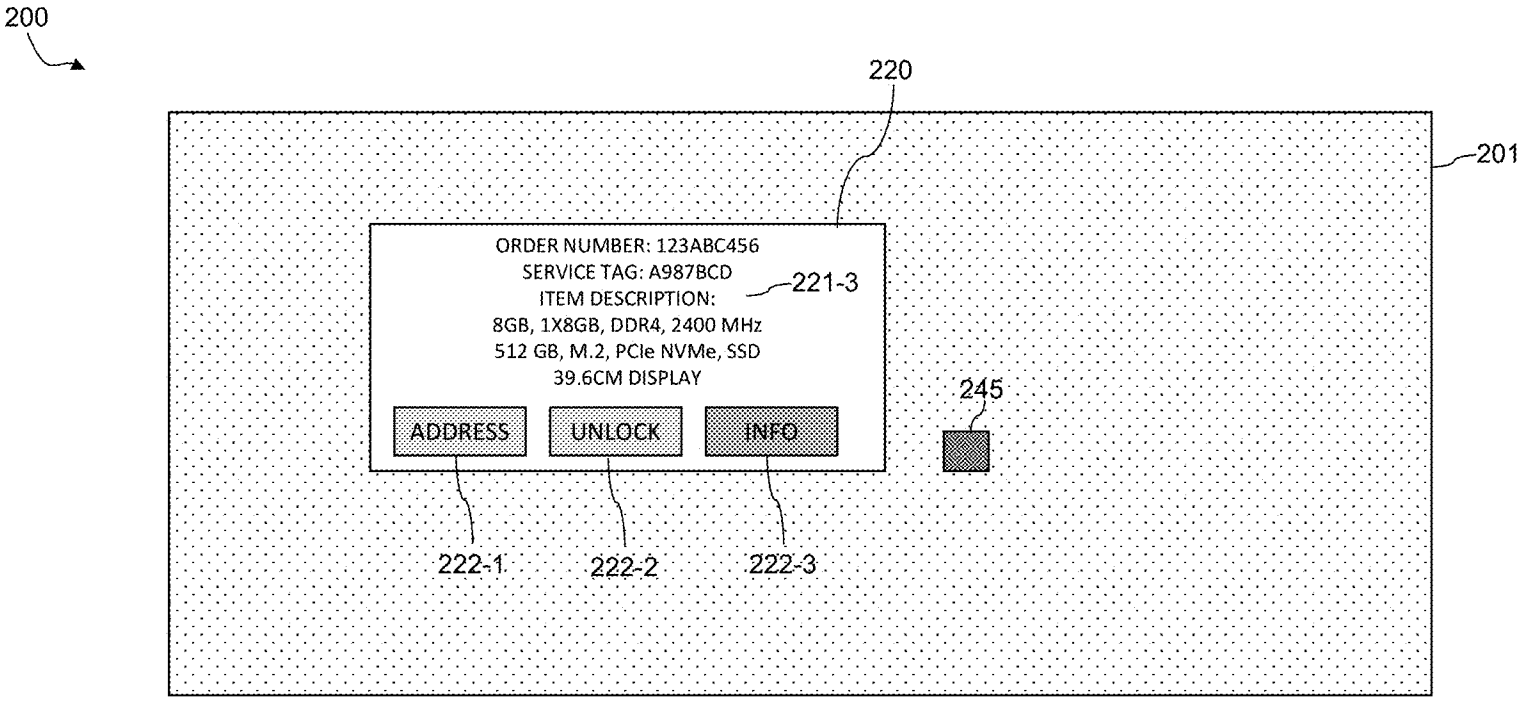
FIG. 2E depicts a top view of a sustainable package including a display panel displaying order and product information according to an illustrative embodiment.
Figure 2F:
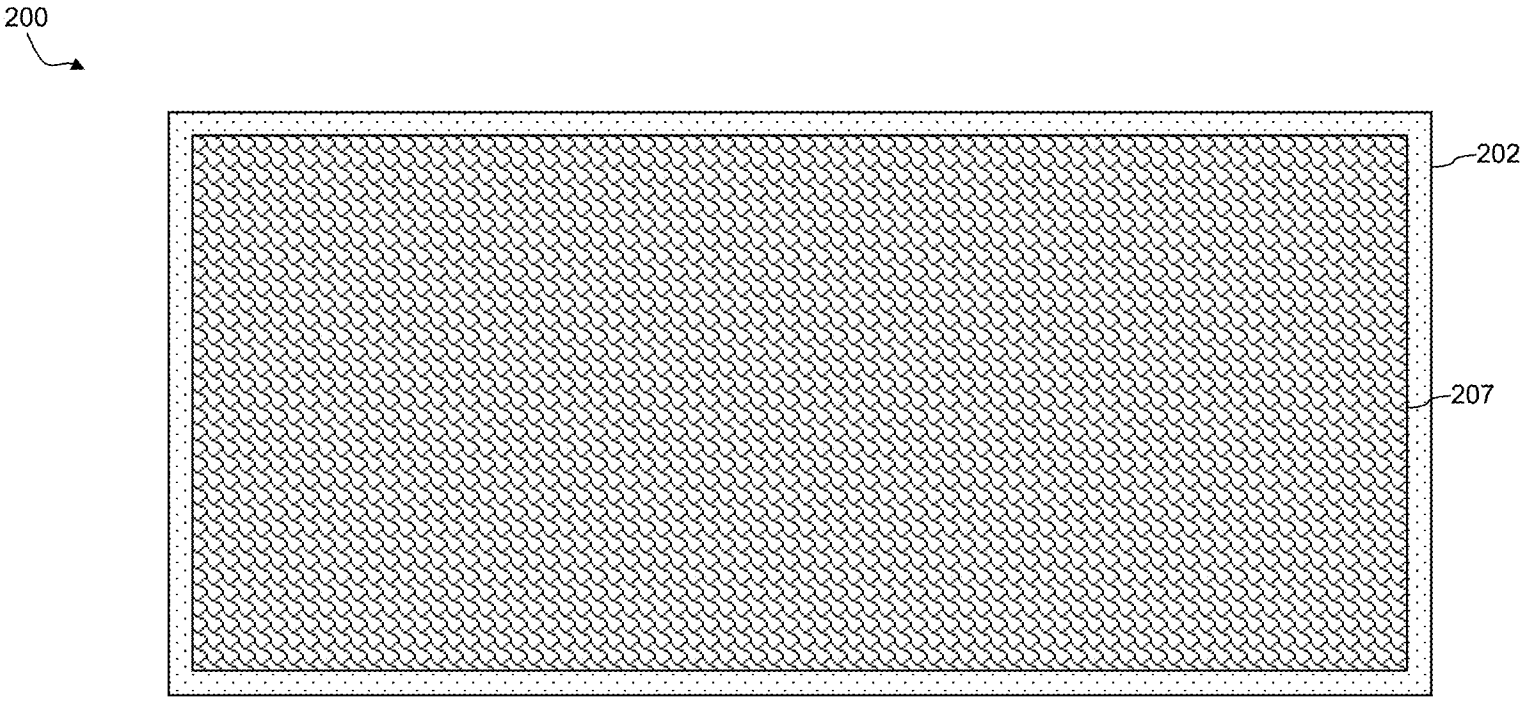
FIG. 2F depicts a top cross-sectional view of a sustainable package according to an illustrative embodiment.

FIGS. 2A-2F depict a sustainable package 200 including a smart package platform (e.g., the smart package platform 110 of FIG. 1). Referring, for example, to FIG. 2A, which is a side cross-sectional view of the sustainable package 200, the sustainable package 200 comprises a box with a cover 201 and a body portion 202. The material of the sustainable package 200 comprises, but is not necessarily limited to, wood, bamboo or other reusable, environmentally friendly, organic and/or biodegradable material. In addition, as explained in more detail, the interior of the body portion 202 comprises, for example, packing material 207 such as, but not necessarily limited to, polyurethane or polyethylene foam (e.g., memory foam), polystyrene and/or styrene copolymer material (e.g., Thermocol), organic materials (e.g., organic foam), biodegradable materials or other packing material. In some embodiments, the packing material 207 takes the shape of items (e.g., products) in the sustainable package 200. FIG. 2A illustrates example products 215-1 and 215-2 (e.g., a laptop computer and charger, respectively) in the body portion 202 and surrounded by packing material 207 to protect the products 215-1 and 215-2. FIG. 2F depicts a top cross-sectional view of the sustainable package 200 showing the interior of the body portion 202 including the packing material 207 therein. The packing material 207 can be varied, for example, based on the contents of the sustainable package 200. Although not shown, packing material may also be used in the cover 201.

As shown in FIG. 2A, the cover 201 includes a display panel 220 and circuitry 230, which may correspond to the display 120 and circuitry 130 in FIG. 1. The cover 201 is connected to the body portion 202 via a hinge 205 and is configured to be locked via a locking device 211 in a closed position to seal the sustainable package 200. The locking device 211 may correspond to the locking component 111 in FIG. 1. The locking device 211 comprises an electronic locking device that can be electronically activated (e.g., locked) and deactivated (unlocked) via one or more commands, codes and/or electronic (e.g., digital) signals. In some embodiments, the locking device 211 comprises an electro-magnetic device with a magnet that can be turned on and off, an electronically activated latch or clasping mechanism that can be engaged and disengaged, or other electromechanical locking mechanism. FIG. 2B depicts a front view of the sustainable package 200 showing the locking device 211. As explained in more detail herein, the assignment of users with access to release or open of locking device 211 is performed digitally to secure items in the sustainable package 200 and prevent tampering.

FIG. 2B further illustrates that the sustainable package 200 further comprises one or more ports 241 for receiving connectors, one or more storage devices 242 and a power port 243 disposed in the cover 201. For example, the ports 241, which may correspond to the port(s) 141 in FIG. 1, can include, but are not necessarily limited to, universal serial bus (USB), micro-USB, USB-mini, USB-C, lightning and/or high-definition multimedia interface (HDMI) ports. A computer, tablet, mobile phone or other processing device can connect to the sustainable package 200 via the one or more ports 241. The storage devices 242, which may correspond to the storage component 142 in FIG. 1, can include, for example, a flash-memory data storage device (e.g., memory stick, flash drive, solid state drives (SSDs)) or other data storage device. In some embodiments, the storage device is selectively removable by a user by detaching the storage device 242 from a port (e.g., USB port) in a slot (or other opening/recess) of the sustainable package 200. The power port 243 comprises a port for connecting to an AC adapter to provide AC power to the circuitry 230 and/or charge a rechargeable battery (e.g., battery 232 in FIG. 3 discussed herein below).

FIGS. 2C-2E depict top views of the sustainable package 200 including the display panel 220 displaying destination information 221-1 (FIG. 2C), unlocking functionality 221-2 (FIG. 2D), and order and product information 221-3 (FIG. 2E). The display panel 220 can include, for example, a liquid crystal display (LCD) panel, a light-emitting diode (LED) panel, an organic LED (OLED) panel or other type of electronic display panel. In illustrative embodiments, the display panel 220 comprises touch-screen functionality for a user to provide inputs by directly touching the display panel 220 to, for example, input numbers or letters from a virtual keyboard and activate icons by touching the icons. For example, as can be seen in FIG. 2C, an address icon 222-1 is activated to display and/or edit a field for destination information 221-1, such as, for example, a name and address for a recipient of the sustainable package 200. In FIG. 2D, an unlock icon 222-2 is activated to display a field for entering an access code (e.g., one-time password (OTP)) to unlock the locking device 211. In connection with the unlocking functionality 221-2, the display panel 220 displays a field 223 for entering the access code and a "Submit" icon 224 to submit the password and unlock the locking device 211 once entered. In FIG. 2E, the info (information) icon 222-3 is activated to display order and product information 221-3, such as, for example, an order number, a service tag and an item description associated with one or more products in the sustainable package 200.

As explained in more detail herein, in illustrative embodiments, the display panel 220 securely displays, to designated users, information such as, for example, customer location, product details and billing information. The display panel 220 may be securely operated by authorized persons (e.g., role-based access control, persona-based control (e.g., customer, logistics, etc.)) such that users can be limited to what information they are permitted to view on the display panel 220 based on, for example, their role or function. For example, delivery teams, logistics teams, financial teams, etc. may be limited to viewing relevant customer information on demand (e.g., by entering an OTP and/or by using two-factor authorization). In illustrative embodiments, through one or more inputs on the display panel 220, a sustainable package 200 with network connectivity functionality may automatically contact a customer for a user without displaying the customer's contact information (e.g., phone number, email address, etc.). In addition, in illustrative embodiments, a customer's address is not necessarily displayed on the display panel 220, and instead latitudinal, longitudinal and/or other global positioning system (GPS) coordinates and/or digital maps can be used (e.g., in conjunction with GPS systems) to reach a delivery destination. Additionally, updates to destination information can be sent to the sustainable package 200 in real-time to avoid delivery to a wrong location. In one or more embodiments, destination data can be uploaded from the sustainable package 200 and/or enterprise server 150 to automated delivery devices (e.g., drones) that will deliver the sustainable package 200.

Referring to FIGS. 2C-2E, the sustainable package 200 further includes a short-range wireless reader 245, which may correspond to the short-range wireless reader 145 in FIG. 1. As explained in more detail herein, the short-range wireless reader 245 includes, for example, an NFC reader or other short-range wireless receiver device configured to receive data, commands or other communications from a device in close-proximity. The data, commands or other communications transmitted via short-range wireless techniques may comprise, for example, the destination, order and product information, as well as access codes (e.g., OTPs) for activating/deactivating the locking device 211 or permitting access to certain users as described herein. For example, instead of inputting an OTP via the display panel 220, a customer may use their mobile device (e.g., mobile phone, tablet, etc.) to send the OTP to the short-range wireless reader 245 to unlock the locking device 211. The data, commands or other communications received by the short-range wireless reader 245 via short-range wireless techniques can be stored in the storage device(s) 242.

Figure 3:
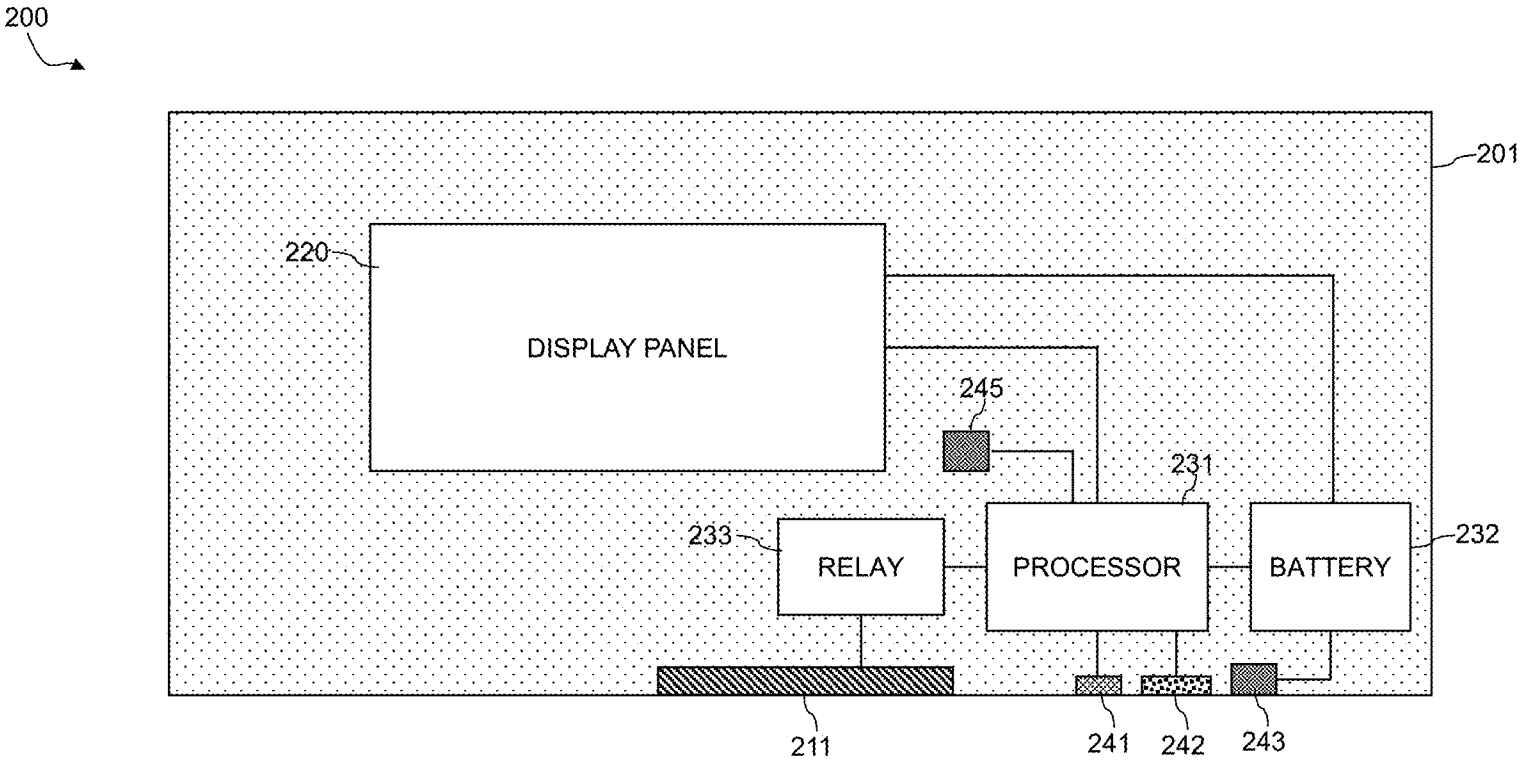
FIG. 3 depicts a block diagram of a circuit in a top cover of a sustainable package according to an illustrative embodiment.

FIG. 3 depicts a block diagram of circuitry 230 in the cover 201 of the sustainable package 200. In one or more illustrative embodiments, the circuitry 230 comprises, but is not necessarily limited to, a processor 231, a battery 232 and a relay 233. As can be seen, the processor 231 is connected to the battery 232, relay 233, display panel 220, short-range wireless reader 245, port(s) 241 and storage device(s) 242. In illustrative embodiments, the processor 231 processes received data, commands or other communications in order to store and/or display the received data, commands or other communications. In addition, the processor 231 uses the received data, commands or other communications to lock and unlock the locking device 211. For example, an access code (e.g., OTP) or command entered via the display panel 220 is processed by the processor 231 and sent via the relay 233 to activate or deactivate the locking device 211. In another example, data, commands or other communications received by the sustainable package 200 via the one or more ports 241 and/or the short-range wireless reader 245 are processed by the processor 231 for display on the display panel 220, action on the locking device 211 via the relay 233 and/or storage in the one or more storage devices 242. In a non-limiting example, the processor 231 comprises, at least in part, a Raspberry Pi® processor or some other small single-board computer (SBC). The battery 232 comprises, for example, a rechargeable battery such as a nickel cadmium (NiCad), nickel metal hydride (NiMH), or lithium ion (Li-ion) battery. As noted above, the power port 243 comprises a port for connecting to an AC adapter to provide AC power to the circuitry 230 and/or charge the battery 232.

Figure 4:
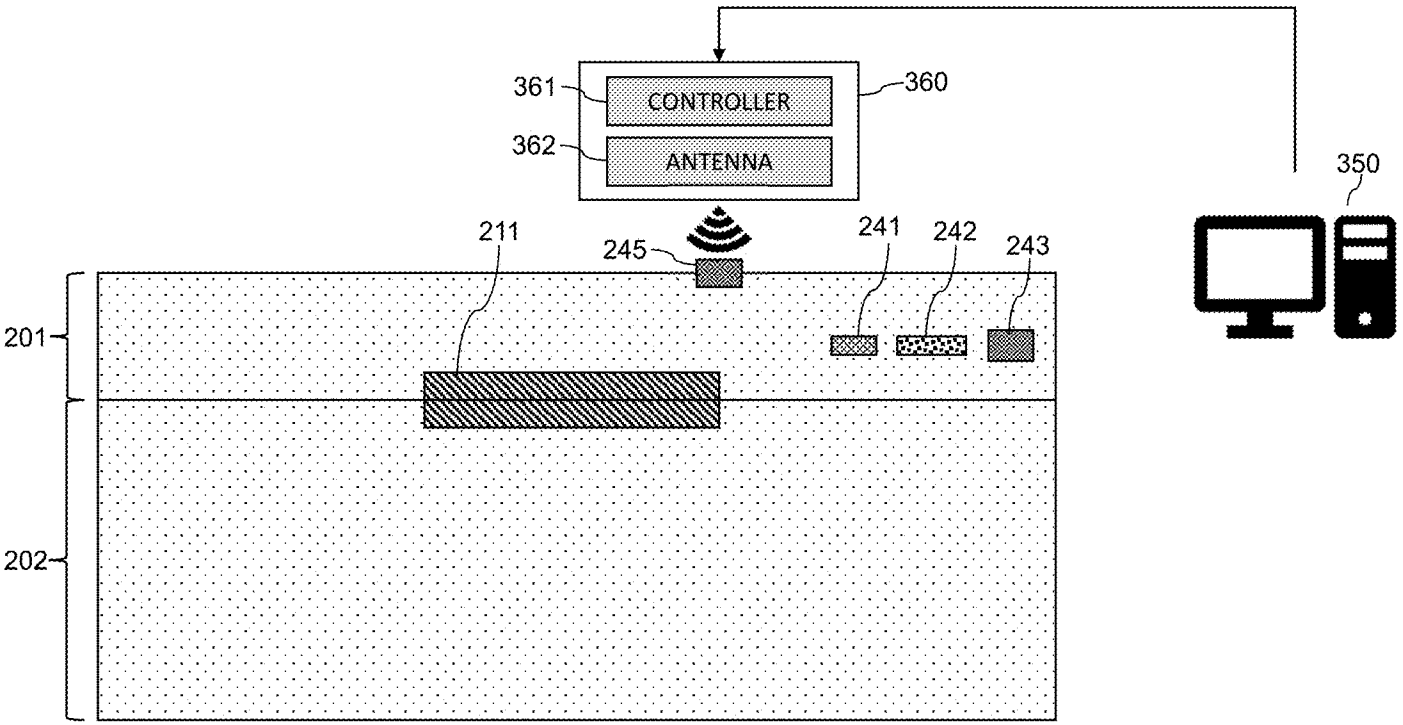
FIG. 4 depicts a block diagram of short-range wireless communication with a sustainable package according to an illustrative embodiment.

Referring to FIG. 4, an enterprise server 350, which may correspond to the enterprise server 150 in FIG. 1, sends, for example, order data to a short-range wireless device 360 for transmission to the sustainable package 200. The short-range wireless device 360 can be, for example, a tablet or other device (e.g., hand-held, mobile or portable device) configured to transmit data via short-range wireless techniques. The short-range wireless device 360 comprises a controller 361, which controls the short-range wireless transmission, and an antenna 362 from which the short-range wireless signal is transmitted. As seen in FIG. 4, the transmission from the short-range wireless device 360 is to the short-range wireless reader 245 of the sustainable package 200.

In a non-limiting operational example, the enterprise server 350 using, for example, a short-range wireless interface (e.g., short-range wireless interface 153) sends order data over the network 104 to the short-range wireless device 360. The short-range wireless device 360 may be, for example, operated by a user in a warehouse or distribution center where the sustainable package 200 is being packed and set up for shipping and delivery to a customer. The order data may comprise, but is not necessarily limited to, package destination information (e.g., customer name and address), order identifying information (e.g., similar to the order information in the order and product information 221-3 shown in FIG. 2E) and a description of one or more products in an order (e.g., similar to the product information in the order and product information 221-3 shown in FIG. 2E). The order data may also include, for example, the access code(s) to be used by administrative personnel or customers (e.g., OTPs) to unlock and/or lock the locking device 211. As noted herein, the short-range wireless techniques may vary, and can include, for example, NFC techniques.

In illustrative embodiments, when the short-range wireless device 360 is brought into close proximity (e.g., a few (<5) centimeters) or touches the short-range wireless reader 245 of the sustainable package 200, the order data is transmitted from the short-range wireless device 360 to the short-range wireless reader 245 and processed by, for example, the processor 231. In this case, the order data can be stored in the one or more storage devices 242 of the sustainable package 200. In illustrative embodiments, short-range wireless transmission is used to configure and reconfigure order data from, for example, an enterprise resource planning (ERP) system, facilitating manufacturing plant and distribution center automation of order fulfillment.

Figure 5:
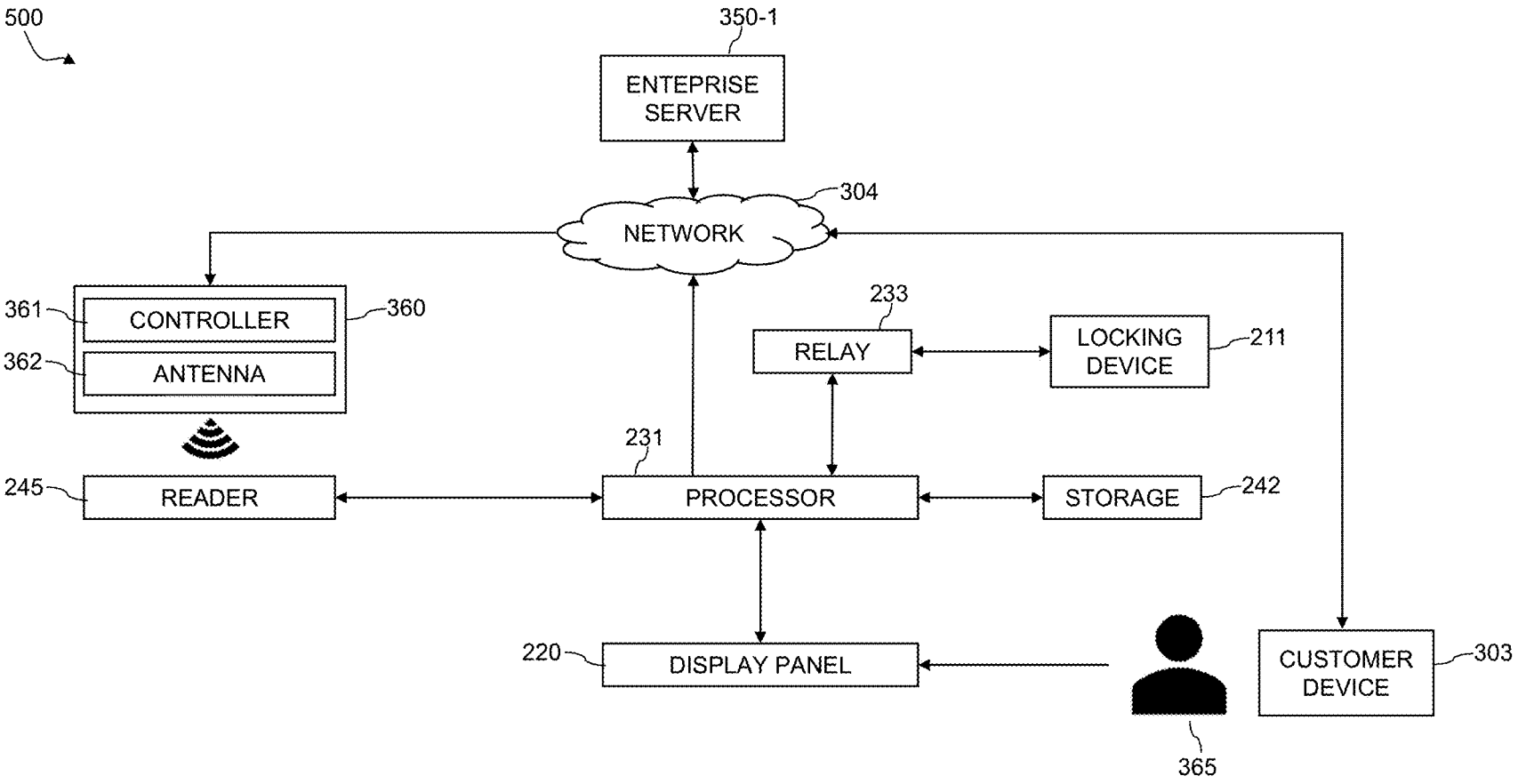
FIG. 5 depicts an operational flow of short-range wireless communication with a sustainable package and communication with a customer in connection with unlocking of the sustainable package according to an illustrative embodiment.

Referring to the operational flow 500 in FIG. 5, similar to what is shown in FIG. 4, an enterprise server 350-1 using, for example, a short-range wireless interface (e.g., short-range wireless interface 153) sends order data over the network 304 (which is the same or similar to network 104) to the short-range wireless device 360. The short-range wireless device 360, when brought into close proximity or in physical contact with the short-range wireless reader 245 of the sustainable package 200, transmits the order data to the short-range wireless reader 245. The order data is processed by the processor 231, and can be stored in the one or more storage devices 242 of the sustainable package 200. FIG. 5 further illustrates transmission of the access code (e.g., OTP) from the enterprise server 350-1 over network 304 to a customer device 303, which may be the same or similar to one of the customer devices 103 in FIG. 1. The enterprise server 350-1, for example, sends the access code to an email address or a mobile phone number of the customer. In illustrative embodiments, the access code is not sent to carriers of the sustainable package 200.

In connection with the unlocking functionality 221-2, a customer 365 via, for example, the field 223 on the display panel 220 for entering the access code (e.g., OTP) to unlock the locking device 211, enters the access code and presses the "Submit" icon 224 to submit the access code and unlock the locking device 211. Alternatively, as noted herein above, the customer 365 uses their mobile device to transmit the access code via short-range wireless techniques to the short-range wireless reader 245. As can be seen in FIG. 5, the access code is processed by the processor 231 and sent to the locking device 211 via the relay 233. Once the locking device 211 (e.g., electro-mechanical or electro-magnetic latch) is opened, a signal is returned via the relay 233 to the processor 231, which generates and sends a notification to the enterprise server 350-1 over network 304 that the sustainable package has 200 has been unlocked (e.g., opened). The notification is sent in real-time in response to the unlocking event of the locking device 211 and serves as proof that the sustainable package 200 has been delivered to the customer 365.

In one or more embodiments, by entering an administrator access code on the display panel 220 or via short-range wireless techniques, personnel at a distribution or merge center may be able to open the sustainable package 200 and/or reconfigure order data as needed prior to receipt of the sustainable package 200 by the customer 365. The administrator access code may be stored in one or more of the storage devices 242 of the sustainable package 200 and sent to the sustainable package 200 with the original order data.

Figure 6:
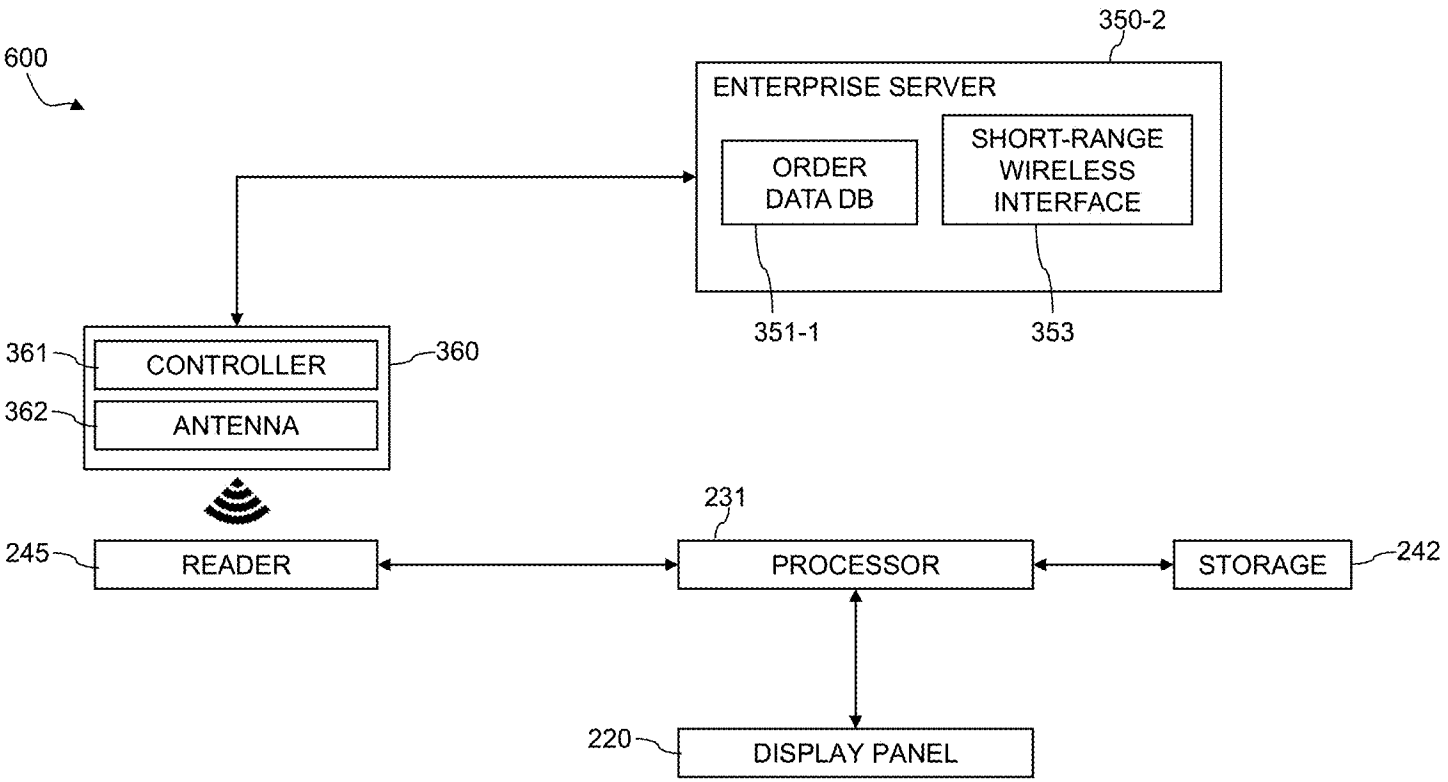
FIG. 6 depicts an operational flow of short-range wireless communication with a sustainable package to communicate order data according to an illustrative embodiment.

Referring to the operational flow 600 in FIG. 6, similar to what is shown in FIG. 4, order data from an order data database (DB) 351-1 is sent from an enterprise server 350-2 to a short-range wireless device 360. Using, for example, a short-range wireless interface 353, the enterprise server 350-2 sends order data over a network (e.g., network 104/304) to the short-range wireless device 360 comprising a controller 361 and an antenna 362. The order data is transmitted from the short-range wireless device 360 to the short-range wireless reader 245, processed by the processor 231, and stored in the one or more storage devices 242 of the sustainable package 200. The order data can be displayed on the display panel 220 for authorized users.

Figure 7:
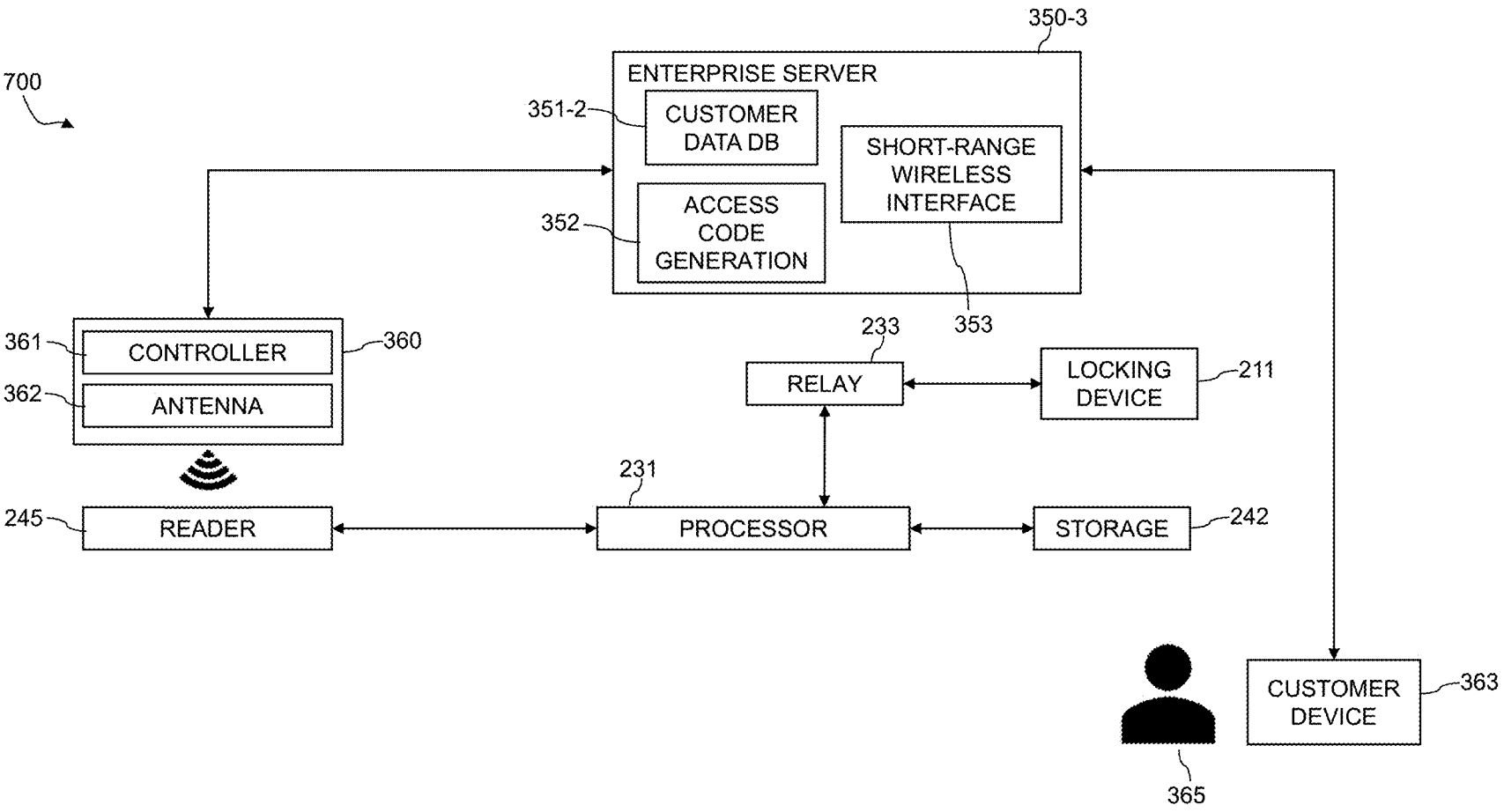
FIG. 7 depicts an operational flow of short-range wireless communication with a sustainable package and communication with a customer in connection with unlocking of the sustainable package according to an illustrative embodiment.

Similar to what is shown in FIG. 5, FIG. 7 depicts an operational flow 700 where, after packing and closing a sustainable package 200, an enterprise server 350-3 comprising a customer data database (DB) 351-2, an access code generation component 352 and a short-range wireless interface 353 generates and transmits an access code (e.g., OTP) for opening the sustainable package 200 (e.g., unlocking the locking device 211) to a customer device 303. Using the customer data from the customer data DB 351-2, the enterprise server 350-3 retrieves an email address or mobile phone number for the customer and sends the access code generated by the access code generation component 352 to the email and/or mobile phone number of the customer 365. In addition, the enterprise server 350-3 sends the access code to the sustainable package 200 via the short-range wireless device 360 and the short-range wireless reader 245. The access code is stored in the storage device 242 of the sustainable package 200, enabling the processor 231 to verify that the access code entered by a customer 365 to unlock the locking device 211 matches with the stored access code. In one or more embodiments, upon verification of a match, the processor 231 sends a signal to the relay 233 to open the locking device 211.

Figure 8:
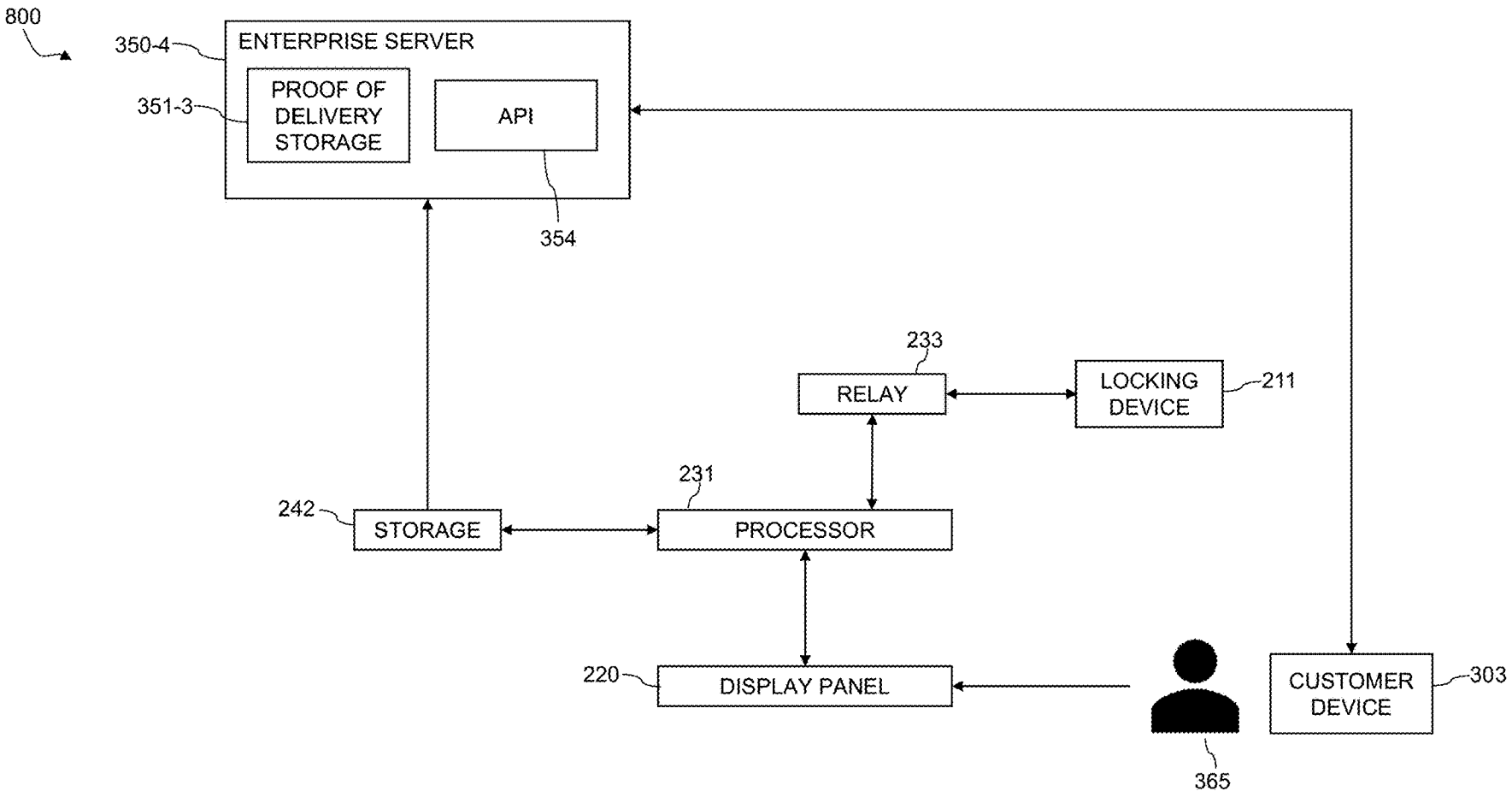
FIG. 8 depicts an operational flow of communication in connection with proof of delivery of a sustainable package according to an illustrative embodiment

Referring to the operational flow 800 in FIG. 8, once a customer 365 enters the access code (e.g., OTP) to unlock the locking device 211 via the display panel 220, and the access code is verified as a match with the stored access code, the locking device 211 is unlocked. As can be understood from FIG. 8, once the locking device 211 is unlocked, a signal is returned via the relay 233 to the processor 231, which generates a proof of delivery notification that is stored in the storage device 242. The proof of delivery notification is sent from the storage device 242 to the enterprise server 350-4 over network 304 in real-time in response to the unlocking event of the locking device 211. The enterprise server 350-4 comprises a proof of delivery storage component 351-3 which stores the proof of delivery notification and an application programming interface (API) 354 for interfacing with the customer device 303. Although not necessarily shown in FIGS. 5-8, one or more components in enterprise servers 350-1, 350-2, 350-3 and 350-4 may be present in other ones of the enterprise servers 350-1, 350-2, 350-3 and 350-4.

Figure 9:
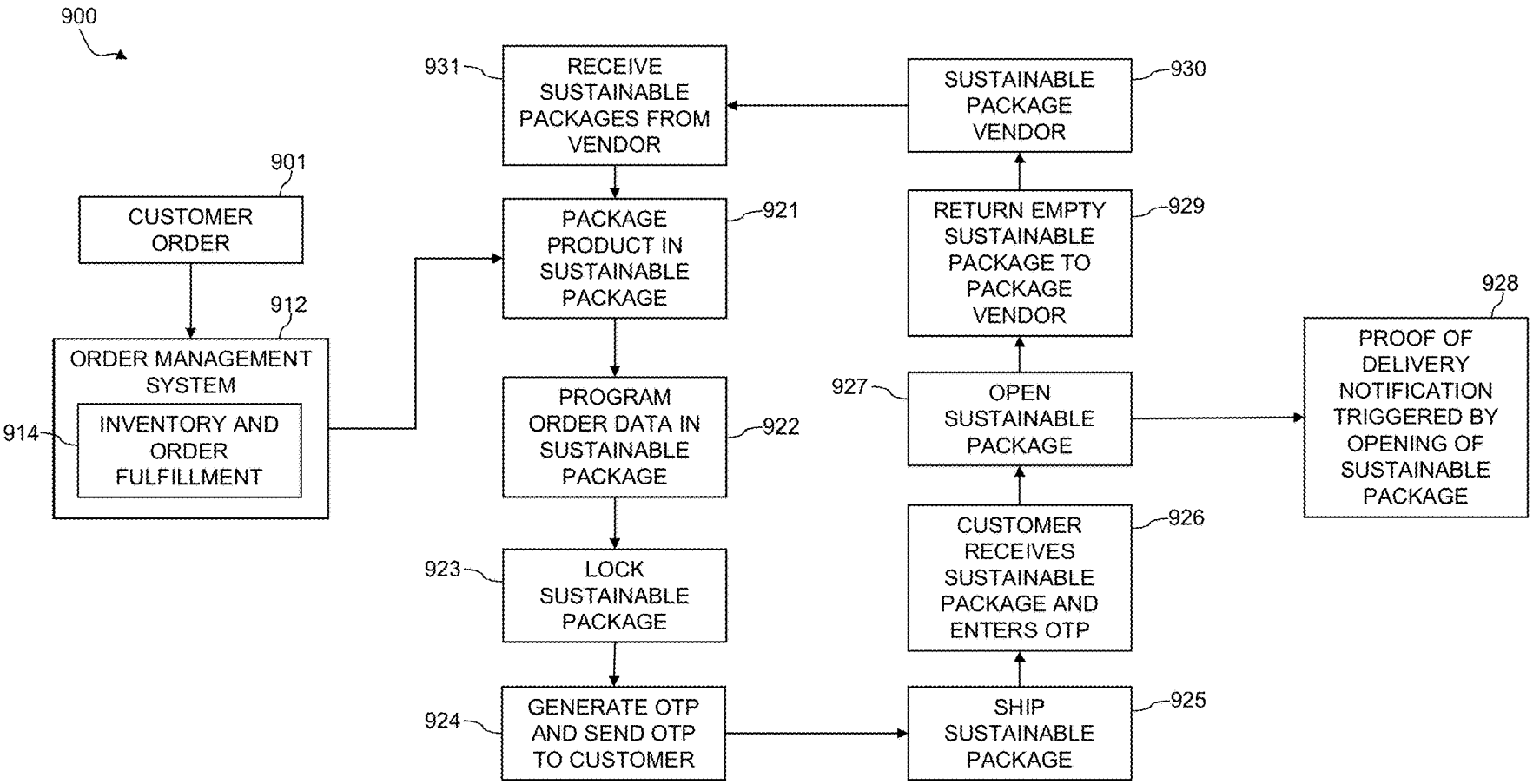
FIG. 9 depicts an operational flow for implementation of a sustainable packaging system according to an illustrative embodiment.

FIG. 9 depicts an operational flow 900 for implementation of a sustainable packaging system according to an illustrative embodiment. Referring to FIG. 9, a customer order 901 is received by an order management system 912. The received order is processed by an inventory and order fulfillment component 914, which records the order data, confirms that the ordered product(s) are in inventory, and sends the order data to a distribution center or warehouse with a directive that the products be packaged and shipped. At block 921, the ordered product(s) is packed in a sustainable package 200, and at block 922, the order data including, for example, package destination information, order identifying information, and a description of one or more products in an order, is programmed into the sustainable package 200 using the transmission techniques described herein. Then, at block 923, the sustainable package is locked. Referring to block 924, an OTP for unlocking the package is generated, sent to the customer and stored in a memory of the sustainable package 200 as described herein.

At block 925, the sustainable package 200 is shipped and at block 926, the customer receives the sustainable package 200 and enters the received OTP to unlock the sustainable package 200. At block 927, the sustainable package 200 is unlocked (opened) and at block 928, a proof of delivery notification triggered by the opening of the sustainable package 200 is sent in real-time to the enterprise from which the products were ordered. At block 929, after unpacking the sustainable package 200, the empty sustainable package 200 is returned to a package vendor 930, which resets the sustainable package 200 to default settings. At block 931, the package vendor 930 supplies sustainable packages to the enterprise distribution center, which re-uses the received sustainable packages to ship subsequent orders.

According to one or more embodiments, databases (e.g., databases 151 and 351) used by the enterprise servers 150 and 350 can be configured according to a relational database management system (RDBMS) (e.g., PostgreSQL). Databases in some embodiments are implemented using one or more storage systems or devices associated with the enterprise servers 150 and 350. In some embodiments, one or more of the storage systems utilized to implement the databases comprise a scale-out all-flash content addressable storage array or other type of storage array.

The term "storage system" as used herein is therefore intended to be broadly construed, and should not be viewed as being limited to content addressable storage systems or flash-based storage systems. A given storage system as the term is broadly used herein can comprise, for example, network-attached storage (NAS), storage area networks (SANs), direct-attached storage (DAS) and distributed DAS, as well as combinations of these and other storage types, including software-defined storage.

Other particular types of storage products that can be used in implementing storage systems in illustrative embodiments include all-flash and hybrid flash storage arrays, software-defined storage products, cloud storage products, object-based storage products, and scale-out NAS clusters. Combinations of multiple ones of these and other storage products can also be used in implementing a given storage system in an illustrative embodiment.

Although shown as elements of the enterprise servers 150 and/or 350, databases 151/351, access code generation components 152/352, short-range wireless interfaces 153/353, and APIs 354 in other embodiments can be implemented at least in part externally to the enterprise servers 150 and/or 350, for example, as stand-alone servers, sets of servers or other types of systems coupled to the network 104/304. For example, the databases 151/351, access code generation components 152/352, short-range wireless interfaces 153/353, and APIs 354 may be provided as cloud services accessible by the enterprise servers 150 and/or 350.

The databases 151/351, access code generation components 152/352, short-range wireless interfaces 153/353, and APIs 354 in the illustrative embodiments are each assumed to be implemented using at least one processing device. Each such processing device generally comprises at least one processor and an associated memory, and implements one or more functional modules for controlling certain features of the databases 151/351, access code generation components 152/352, short-range wireless interfaces 153/353, and/or APIs 354.

At least portions of the smart package platform 110, the enterprise servers 150/350, the sustainable package 200 and the components thereof may be implemented at least in part in the form of software that is stored in memory and executed by a processor. The smart package platform 110, enterprise servers 150/350, the sustainable package 200 and the components thereof comprise further hardware and software required for running the smart package platform 110, the sustainable package 200 and the enterprise servers 150/350, including, but not necessarily limited to, on-premises or cloud-based centralized hardware, graphics processing unit (GPU) hardware, virtualization infrastructure software and hardware, Docker containers, networking software and hardware, and cloud infrastructure software and hardware.

Although the databases 151/351, access code generation components 152/352, short-range wireless interfaces 153/353, APIs 354 and other components of the enterprise servers 150 and/or 350 in the present embodiment are shown as part of the enterprise servers 150 and/or 350, at least a portion of the databases 151/351, access code generation components 152/352, short-range wireless interfaces 153/353, APIs 354 and other components of the enterprise servers 150 and/or 350 in other embodiments may be implemented on one or more other processing platforms that are accessible to the enterprise servers 150 and/or 350 over one or more networks. Such components can each be implemented at least in part within another system element or at least in part utilizing one or more stand-alone components coupled to the network 104/304.

It is assumed that the smart package platform 110, the enterprise servers 150/350 and the sustainable package 200 in the illustrative embodiments and other processing platforms referred to herein may each be implemented using a plurality of processing devices each having a processor coupled to a memory. Such processing devices can illustratively include particular arrangements of compute, storage and network resources. For example, processing devices in some embodiments are implemented at least in part utilizing virtual resources such as virtual machines (VMs) or Linux containers (LXCs), or combinations of both as in an arrangement in which Docker containers or other types of LXCs are configured to run on VMs.

The term "processing platform" as used herein is intended to be broadly construed so as to encompass, by way of illustration and without limitation, multiple sets of processing devices and one or more associated storage systems that are configured to communicate over one or more networks.

As a more particular example, the databases 151/351, access code generation components 152/352, short-range wireless interfaces 153/353, APIs 354 and other components of the enterprise servers 150 and/or 350, and the elements thereof can each be implemented in the form of one or more LXCs running on one or more VMs. Other arrangements of one or more processing devices of a processing platform can be used to implement the databases 151/351, access code generation components 152/352, short-range wireless interfaces 153/353 and the APIs 354, as well as other components of the enterprise servers 150 and/or 350. Other portions of the system 100 can similarly be implemented using one or more processing devices of at least one processing platform.

Distributed implementations of the system 100 are possible, in which certain components of the system reside in one datacenter in a first geographic location while other components of the system reside in one or more other data centers in one or more other geographic locations that are potentially remote from the first geographic location. For example, it is possible in some implementations of the system 100 for different portions of the enterprise servers 150 and/or 350 to reside in different data centers. Numerous other distributed implementations of the enterprise servers 150 and/or 350 are possible.

Accordingly, one or each of the databases 151/351, access code generation components 152/352, short-range wireless interfaces 153/353, APIs 354 and other components of the enterprise servers 150 and/or 350 can each be implemented in a distributed manner so as to comprise a plurality of distributed components implemented on respective ones of a plurality of compute nodes of the enterprise servers 150 and/or 350.

It is to be appreciated that these and other features of illustrative embodiments are presented by way of example only, and should not be construed as limiting in any way. Accordingly, different numbers, types and arrangements of components of the smart package platform 110, the enterprise servers 150/350, the sustainable package 200 and the elements thereof can be used in other embodiments.

It should be understood that the particular sets of modules and other components implemented in the illustrative embodiments are presented by way of example only. In other embodiments, only subsets of these components, or additional or alternative sets of components, may be used, and such components may exhibit alternative functionality and configurations.

Figure 10:
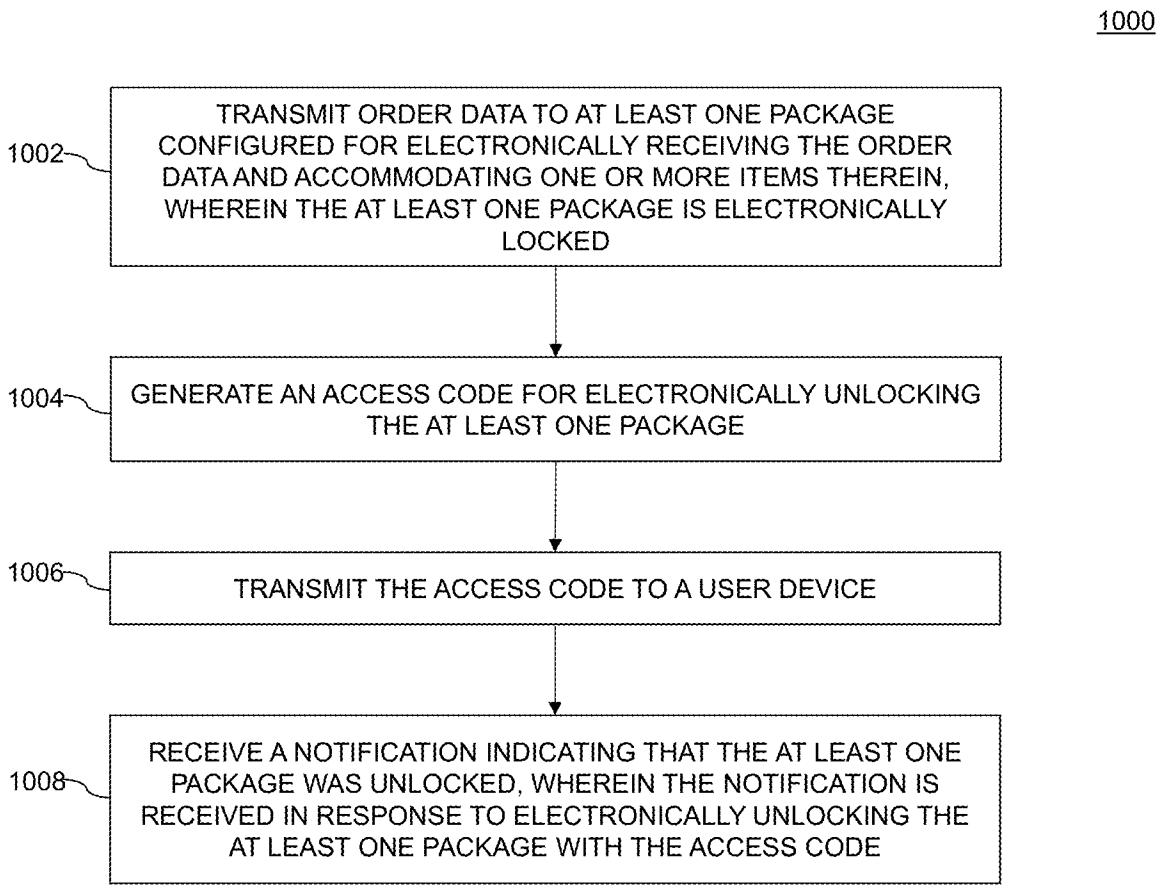
FIG. 10 depicts a process for implementation of a sustainable packaging system according to an illustrative embodiment.

With reference to FIG. 10, a process 1000 for implementation of a sustainable packaging system as shown includes steps 1002 through 1008, and is suitable for use in the system 100 but is more generally applicable to other types of information processing systems configured for implementation of a sustainable packaging system.

In step 1002, order data is transmitted to at least one package configured for electronically receiving the order data and accommodating one or more items therein, wherein the at least one package is electronically locked. In illustrative embodiments, the order data is transmitted to the at least one package using short-range wireless connectivity, wherein the short-range wireless connectivity comprises NFC, and wherein the order data is transmitted to an NFC reader of the at least one package. One or more updates to the order data may be transmitted to the at least one package.

In step 1004, an access code for electronically unlocking the at least one package is generated. In step 1006, the access code is transmitted to a user device. In illustrative embodiments, the access code comprises an OTP, and is transmitted to the at least one package using short-range wireless connectivity. The access code is processed with at least one processor of the at least one package.

In step 1008, a notification is received indicating that the at least one package was unlocked, wherein the notification is received in response to electronically unlocking the at least one package with the access code. The notification is received in real-time in response to electronically unlocking the at least one package with the access code.

In illustrative embodiments, the order data comprises at least one of package destination information, order identifying information and a description of one or more products in an order. The order data is displayed on an electronic display panel and stored on a storage device of the at least one package. In connection with reusing the at least one package, settings of the at least one package are reset to one or more default settings, wherein the resetting comprises deleting the order data from the storage device of the at least one package.

In illustrative embodiments, an electronically activated lock on the at least one package is automatically locked and unlocked. For example, an activation command or a deactivation command is transmitted to the at least one package that causes the electronically activated lock to lock automatically or unlock automatically. In some cases, the activation or deactivation command is transmitted to the at least one package using one or more short-range connectivity techniques. The at least one package may comprise a sustainable package.

It is to be appreciated that the FIG. 10 process and other features and functionality described above can be adapted for use with other types of information systems configured to implement a sustainable packaging system.

The particular processing operations and other system functionality described in conjunction with the flow diagram of FIG. 10 is therefore presented by way of illustrative example only, and should not be construed as limiting the scope of the disclosure in any way. Alternative embodiments can use other types of processing operations. For example, the ordering of the process steps may be varied in other embodiments, or certain steps may be performed at least in part concurrently with one another rather than serially. Also, one or more of the process steps may be repeated periodically, or multiple instances of the process can be performed in parallel with one another.

Functionality such as that described in conjunction with the flow diagram of FIG. 10 can be implemented at least in part in the form of one or more software programs stored in memory and executed by a processor of a processing device such as a computer or server. As will be described below, a memory or other storage device having executable program code of one or more software programs embodied therein is an example of what is more generally referred to herein as a "processor-readable storage medium."

Illustrative embodiments of systems with a smart package platform as disclosed herein can provide a number of significant advantages relative to conventional arrangements. For example, unlike conventional packaging techniques, the embodiments advantageously provide technical solutions where smart and sustainable packaging can be electronically configured with order data for a designated shipment and then reconfigured with different order data when the packaging is re-used for another designated shipment.

Additionally, the embodiments address technical problems associated with package labeling and failure to receive proof of delivery. For example, the embodiments provide for triggering transmission of proof of delivery notifications upon electronically unlocking packages. The embodiments also advantageously provide for management and control of digital labels on smart packages. The availability of the information on the digital labels is limited to designated parties with authorized access to the information. For example, access to customer addresses, contact numbers, billing information and product details is controlled on the digital labels. In addition, the displayed information can be updated in real time responsive to changes or modifications to the label data.

Unlike conventional packaging techniques, the embodiments provide sustainable packages which can be locked and unlocked digitally. The embodiments advantageously provide controls for limiting unlocking privileges by providing generated access codes (e.g., OTPs) for unlocking electronic locking devices on the packages to designated parties. Moreover, once an access code is validated and a smart package is unlocked, a proof of delivery event (e.g., transmission of a notification to an enterprise server) is triggered in real-time to ensure prompt and accurate delivery confirmation, and reduce the need for third-party manual intervention to address delivery mistakes.

The embodiments further provide technical solutions in which a re-configurable and re-usable smart and sustainable package can be manufactured once and re-used multiple times for different products by resetting the package configuration and inputting new order data corresponding to different products and different recipients.

It is to be appreciated that the particular advantages described above and elsewhere herein are associated with particular illustrative embodiments and need not be present in other embodiments. Also, the particular types of information processing system features and functionality as illustrated in the drawings and described above are exemplary only, and numerous other arrangements may be used in other embodiments.

As noted above, at least portions of the information processing system 100, the sustainable package 200 and corresponding elements in other embodiments (e.g., enterprise servers 350) may be implemented using one or more processing platforms. A given such processing platform comprises at least one processing device comprising a processor coupled to a memory. The processor and memory in some embodiments comprise respective processor and memory elements of a virtual machine or container provided using one or more underlying physical machines. The term "processing device" as used herein is intended to be broadly construed so as to encompass a wide variety of different arrangements of physical processors, memories and other device components as well as virtual instances of such components. For example, a "processing device" in some embodiments can comprise or be executed across one or more virtual processors. Processing devices can therefore be physical or virtual and can be executed across one or more physical or virtual processors. It should also be noted that a given virtual device can be mapped to a portion of a physical one.

Some illustrative embodiments of a processing platform that may be used to implement at least a portion of an information processing system comprise cloud infrastructure including virtual machines and/or container sets implemented using a virtualization infrastructure that runs on a physical infrastructure. The cloud infrastructure further comprises sets of applications running on respective ones of the virtual machines and/or container sets.

These and other types of cloud infrastructure can be used to provide what is also referred to herein as a multi-tenant environment. One or more system components or portions thereof are illustratively implemented for use by tenants of such a multi-tenant environment.

As mentioned previously, cloud infrastructure as disclosed herein can include cloud-based systems. Virtual machines provided in such systems can be used to implement at least portions of one or more of a computer system and a smart package platform in illustrative embodiments. These and other cloud-based systems in illustrative embodiments can include object stores.

Illustrative embodiments of processing platforms will now be described in greater detail with reference to FIGS. 11 and 12. Although described in the context of system 100, these platforms may also be used to implement at least portions of other information processing systems in other embodiments.

Figure 11:
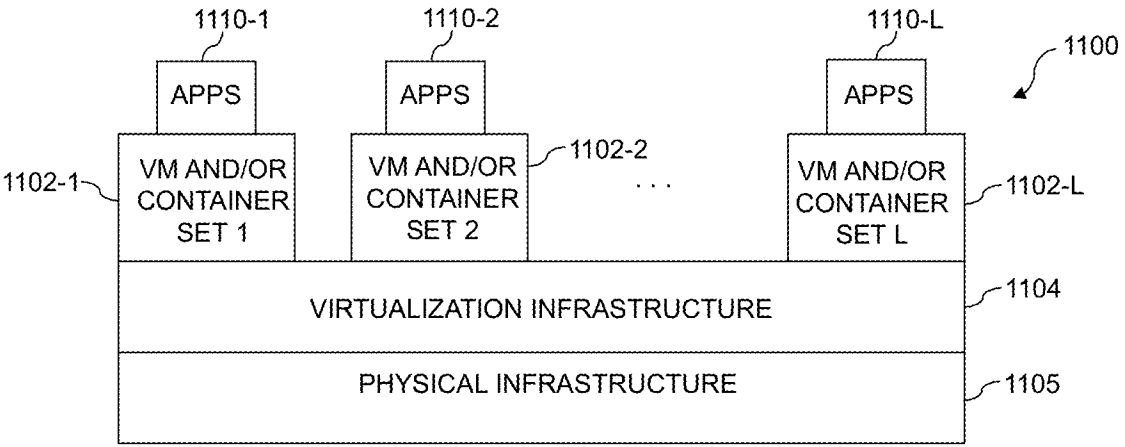
FIGS. 11 and 12 show examples of processing platforms that may be utilized to implement at least a portion of an information processing system according to illustrative embodiments.
Figure 12:
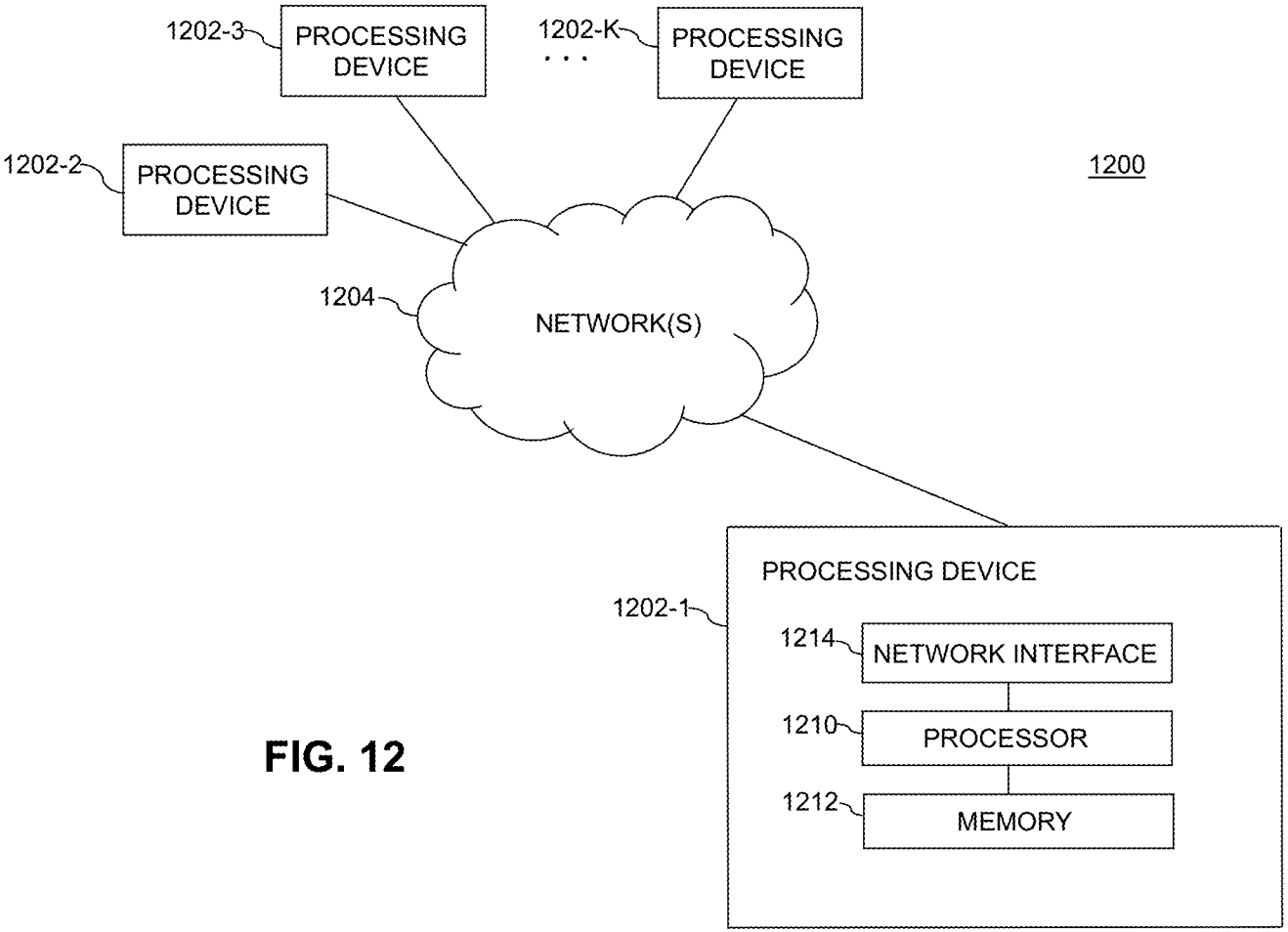

FIG. 11 shows an example processing platform comprising cloud infrastructure 1100. The cloud infrastructure 1100 comprises a combination of physical and virtual processing resources that may be utilized to implement at least a portion of the information processing system 100. The cloud infrastructure 1100 comprises multiple virtual machines (VMs) and/or container sets 1102-1, 1102-2, . . . 1102-L implemented using virtualization infrastructure 1104. The virtualization infrastructure 1104 runs on physical infrastructure 1105, and illustratively comprises one or more hypervisors and/or operating system level virtualization infrastructure. The operating system level virtualization infrastructure illustratively comprises kernel control groups of a Linux operating system or other type of operating system.

The cloud infrastructure 1100 further comprises sets of applications 1110-1, 1110-2, . . . 1110-L running on respective ones of the VMs/container sets 1102-1, 1102-2, . . . 1102-L under the control of the virtualization infrastructure 1104. The VMs/container sets 1102 may comprise respective VMs, respective sets of one or more containers, or respective sets of one or more containers running in VMs.

In some implementations of the FIG. 11 embodiment, the VMs/container sets 1102 comprise respective VMs implemented using virtualization infrastructure 1104 that comprises at least one hypervisor. A hypervisor platform may be used to implement a hypervisor within the virtualization infrastructure 1104, where the hypervisor platform has an associated virtual infrastructure management system. The underlying physical machines may comprise one or more distributed processing platforms that include one or more storage systems.

In other implementations of the FIG. 11 embodiment, the VMs/container sets 1102 comprise respective containers implemented using virtualization infrastructure 1104 that provides operating system level virtualization functionality, such as support for Docker containers running on bare metal hosts, or Docker containers running on VMs. The containers are illustratively implemented using respective kernel control groups of the operating system.

As is apparent from the above, one or more of the processing modules or other components of system 100 may each run on a computer, server, storage device or other processing platform element. A given such element may be viewed as an example of what is more generally referred to herein as a "processing device." The cloud infrastructure 1100 shown in FIG. 11 may represent at least a portion of one processing platform. Another example of such a processing platform is processing platform 1200 shown in FIG. 12.

The processing platform 1200 in this embodiment comprises a portion of system 100 and includes a plurality of processing devices, denoted 1202-1, 1202-2, 1202-3, . . . 1202-K, which communicate with one another over a network 1204.

The network 1204 may comprise any type of network, including by way of example a global computer network such as the Internet, a WAN, a LAN, a satellite network, a telephone or cable network, a cellular network, a wireless network such as a WiFi or WiMAX network, or various portions or combinations of these and other types of networks.

The processing device 1202-1 in the processing platform 1200 comprises a processor 1210 coupled to a memory 1212. The processor 1210 may comprise a microprocessor, a microcontroller, an application-specific integrated circuit (ASIC), a field-programmable gate array (FPGA), a central processing unit (CPU), a graphical processing unit (GPU), a tensor processing unit (TPU), a video processing unit (VPU) or other type of processing circuitry, as well as portions or combinations of such circuitry elements.

The memory 1212 may comprise random access memory (RAM), read-only memory (ROM), flash memory or other types of memory, in any combination. The memory 1212 and other memories disclosed herein should be viewed as illustrative examples of what are more generally referred to as "processor-readable storage media" storing executable program code of one or more software programs.

Articles of manufacture comprising such processor-readable storage media are considered illustrative embodiments. A given such article of manufacture may comprise, for example, a storage array, a storage disk or an integrated circuit containing RAM, ROM, flash memory or other electronic memory, or any of a wide variety of other types of computer program products. The term "article of manufacture" as used herein should be understood to exclude transitory, propagating signals. Numerous other types of computer program products comprising processor-readable storage media can be used.

Also included in the processing device 1202-1 is network interface circuitry 1214, which is used to interface the processing device with the network 1204 and other system components, and may comprise conventional transceivers.

The other processing devices 1202 of the processing platform 1200 are assumed to be configured in a manner similar to that shown for processing device 1202-1 in the figure.

Again, the particular processing platform 1200 shown in the figure is presented by way of example only, and system 100 may include additional or alternative processing platforms, as well as numerous distinct processing platforms in any combination, with each such platform comprising one or more computers, servers, storage devices or other processing devices.

For example, other processing platforms used to implement illustrative embodiments can comprise converged infrastructure.

It should therefore be understood that in other embodiments different arrangements of additional or alternative elements may be used. At least a subset of these elements may be collectively implemented on a common processing platform, or each such element may be implemented on a separate processing platform.

As indicated previously, components of an information processing system as disclosed herein can be implemented at least in part in the form of one or more software programs stored in memory and executed by a processor of a processing device. For example, at least portions of the functionality of one or more components of the smart package platform 110, sustainable package 200 and/or enterprise servers 150/350 as disclosed herein are illustratively implemented in the form of software running on one or more processing devices.

It should again be emphasized that the above-described embodiments are presented for purposes of illustration only. Many variations and other alternative embodiments may be used. For example, the disclosed techniques are applicable to a wide variety of other types of information processing systems. Also, the particular configurations of system and device elements and associated processing operations illustratively shown in the drawings can be varied in other embodiments. Moreover, the various assumptions made above in the course of describing the illustrative embodiments should also be viewed as exemplary rather than as requirements or limitations of the disclosure. Numerous other alternative embodiments within the scope of the appended claims will be readily apparent to those skilled in the art.

What is claimed is:

1. A method, comprising:

transmitting order data to at least one package configured for electronically receiving the order data and accommodating one or more items therein, wherein the at least one package is electronically locked;

transmitting one or more updates to the order data to the at least one package, wherein the one or more updates to the order data comprise one or more destination updates for the at least one package;

transmitting the one or more destination updates to an automated delivery device configured to deliver the at least one package;

generating an access code for electronically unlocking the at least one package;

transmitting the access code to a user device; and receiving a notification indicating that the at least one package was unlocked, wherein the notification is received in response to electronically unlocking the at least one package with the access code;

wherein the steps of the method are executed by at least one processing device operatively coupled to a memory.

2. The method of claim 1, wherein transmitting the order data to the at least one package is performed using short-range wireless connectivity.

3. The method of claim 2, wherein the short-range wireless connectivity comprises near-field communication and wherein the order data is transmitted to a near-field communication reader of the at least one package.

4. The method of claim 1, wherein the access code comprises a one-time password.

5. The method of claim 4, further comprising transmitting the one-time password to the at least one package using short-range wireless connectivity.

6. The method of claim 1, wherein the notification is received in real-time in response to electronically unlocking the at least one package with the access code.

7. The method of claim 1, wherein the order data comprises at least one of package destination information, order identifying information and a description of one or more products in an order.

8. The method of claim 1, wherein the order data is displayed on an electronic display panel of the at least one package.

9. The method of claim 1, wherein the order data is stored on a storage device of the at least one package.

10. The method of claim 9, further comprising resetting settings of the at least one package to one or more default settings, wherein the resetting comprises deleting the order data from the storage device of the at least one package.

11. The method of claim 1, further comprising transmitting one of an activation command and a deactivation command to the at least one package that causes an electronically activated lock on the at least one package to one of lock automatically and unlock automatically.

12. The method of claim 1, wherein the access code is processed with at least one processor of the at least one package.

13. The method of claim 1, wherein the at least one package comprises a sustainable package.

14. An article of manufacture comprising a non-transitory processor-readable storage medium having stored therein program code of one or more software programs, wherein the program code when executed by the at least one processing device causes the at least one processing device to perform the steps of the method of claim 1.

15. An apparatus comprising:

a processing device operatively coupled to a memory and configured to:

transmit order data to at least one package configured for electronically receiving the order data and accommodating one or more items therein, wherein the at least one package is electronically locked;

transmit one or more updates to the order data to the at least one package, wherein the one or more updates to the order data comprise one or more destination updates for the at least one package;

transmit the one or more destination updates to an automated delivery device configured to deliver the at least one package;

generate an access code for electronically unlocking the at least one package;

transmit the access code to a user device; and receive a notification indicating that the at least one package was unlocked, wherein the notification is received in response to electronically unlocking the at least one package with the access code.

16. The apparatus of claim 15, wherein the processing device is configured to transmit the order data to the at least one package using short-range wireless connectivity.

17. The apparatus of claim 15, wherein the notification is received in real-time in response to electronically unlocking the at least one package with the access code.

18. An apparatus comprising:

at least one package configured for accommodating one or more items therein; and a processing device operatively coupled to a memory and configured to:

receive and display order data corresponding to the one or more items, wherein the order data is displayed on an electronic display panel of the at least one package;

receive one or more updates to the order data, wherein the one or more updates to the order data comprise one or more destination updates for the at least one package; and transmit the one or more destination updates to an automated delivery device configured to deliver the at least one package;

electronically lock the at least one package;

receive an access code for electronically unlocking the at least one package;

process the access code to electronically unlock the at least one package; and transmit a notification indicating that the at least one package was unlocked in response to electronically unlocking the at least one package.

19. The apparatus of claim 18, wherein the processing device is configured to receive the order data via one or more short-range wireless connectivity techniques.

20. The apparatus of claim 18, wherein the notification is transmitted in real-time in response to electronically unlocking the at least one package.

* * * * *